US006814300B1

(12) United States Patent
Bernstorff

(10) Patent No.: US 6,814,300 B1
(45) Date of Patent: Nov. 9, 2004

(54) REFILL INDICATOR

(76) Inventor: Michelle Bernstorff, 27465 Briars Pl., Valencia, CA (US) 91354

( * ) Notice: Subject to any disclaimer, the term of this patent is extended or adjusted under 35 U.S.C. 154(b) by 13 days.

(21) Appl. No.: 10/665,627

(22) Filed: Sep. 22, 2003

(51) Int. Cl.[7] ..... A24F 25/00; A61L 9/04

(52) U.S. Cl. ..... 239/35; 239/33; 141/94; 215/388

(58) Field of Search ..... 141/2, 18, 94, 141/95; 53/461, 133.1; 206/306, 446; 239/33, 35; 215/229, 388; 446/71; 229/103.1; 283/74, 79

(56) References Cited

U.S. PATENT DOCUMENTS 2,036,773 A 4/1936 Prudden
3,722,457 A 3/1973 Hartinger
3,957,202 A * 5/1976 Hornsby, Jr. ..... 239/33
4,134,494 A 1/1979 Wong
4,657,182 A * 4/1987 Hoshi ..... 239/33
5,388,697 A 2/1995 James
5,722,219 A * 3/1998 Dobransky ..... 53/461
6,050,214 A 4/2000 OKeefe
6,366,196 B1 4/2002 Green et al.
6,471,391 B1 10/2002 Opitz

* cited by examiner

*Primary Examiner*—Timothy L. Maust

(57) ABSTRACT

A refill indicator includes an elongated member for removably positioning in a drink container. The elongated member has a first end and a second end. A first color indicia is positioned on an outer surface of the elongated member and generally extends from the first end to a middle of the elongated member. A second color indicia is positioned on an outer surface of the elongated member and generally extending from the second end to a middle of the elongated member. Wherein the first color indicia indicates that a refill is requested while the second color indicia indicates that a refill is not desired.

7 Claims, 3 Drawing Sheets

REFILL INDICATOR

BACKGROUND OF THE INVENTION

1. Field of the Invention

The present invention relates to drink refill indicating devices and more particularly pertains to a new drink refill indicating device for providing a visual indication to a wait person that a patron does or does not require a drink refill or replacement.

2. Description of the Prior Art

The use of straws and stirring sticks having indicia thereon is known in the prior art. While these devices fulfill their respective, particular objectives and requirements, the need remains for a device that gives a wait staff visual indication that a patron requests a beverage refill while still retaining the functional use of a straw or stirrer.

SUMMARY OF THE INVENTION

The present invention meets the needs presented above by providing color coded indicia on a straw or stirrer that provides a wait staff with a visual cue for when a patron requires either a drink refill or a replacement drink.

Another object of the present invention is to provide a new drink refill indicating device that uses word indicia on the straw or stirrer for indicating to the patron how the color codes are to be interpreted.

To this end, the present invention generally comprises an elongated member for removably positioning in a drink container. The elongated member has a first end and a second end. A first color indicia is positioned on an outer surface of the elongated member and generally extends from the first end to a middle of the elongated member. A second color indicia is positioned on an outer surface of the elongated member and generally extending from the second end to a middle of the elongated member. Wherein the first color indicia indicates that a refill is requested while the second color indicia indicates that a refill is not desired.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
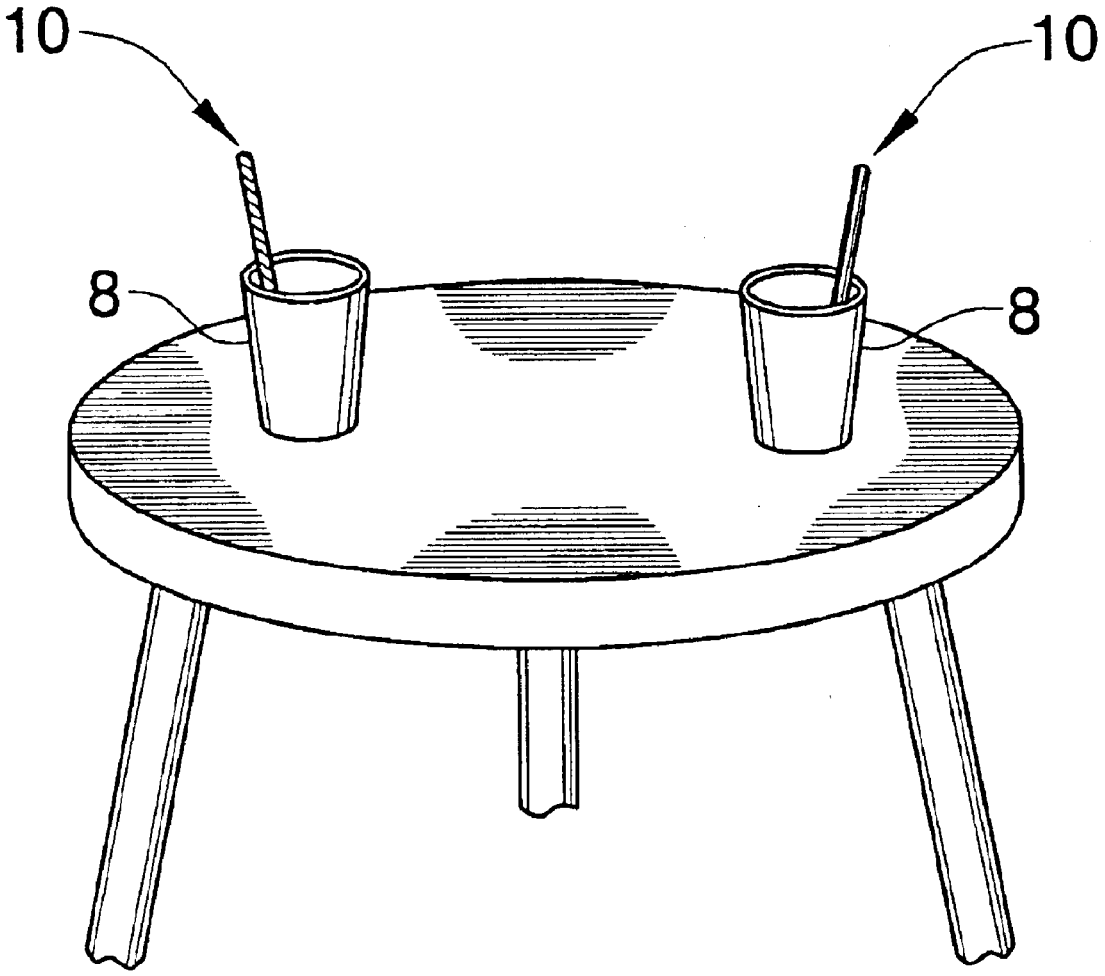
FIG. 1 is a schematic in-use view of a refill indicator according to the present invention.
Figure 2:
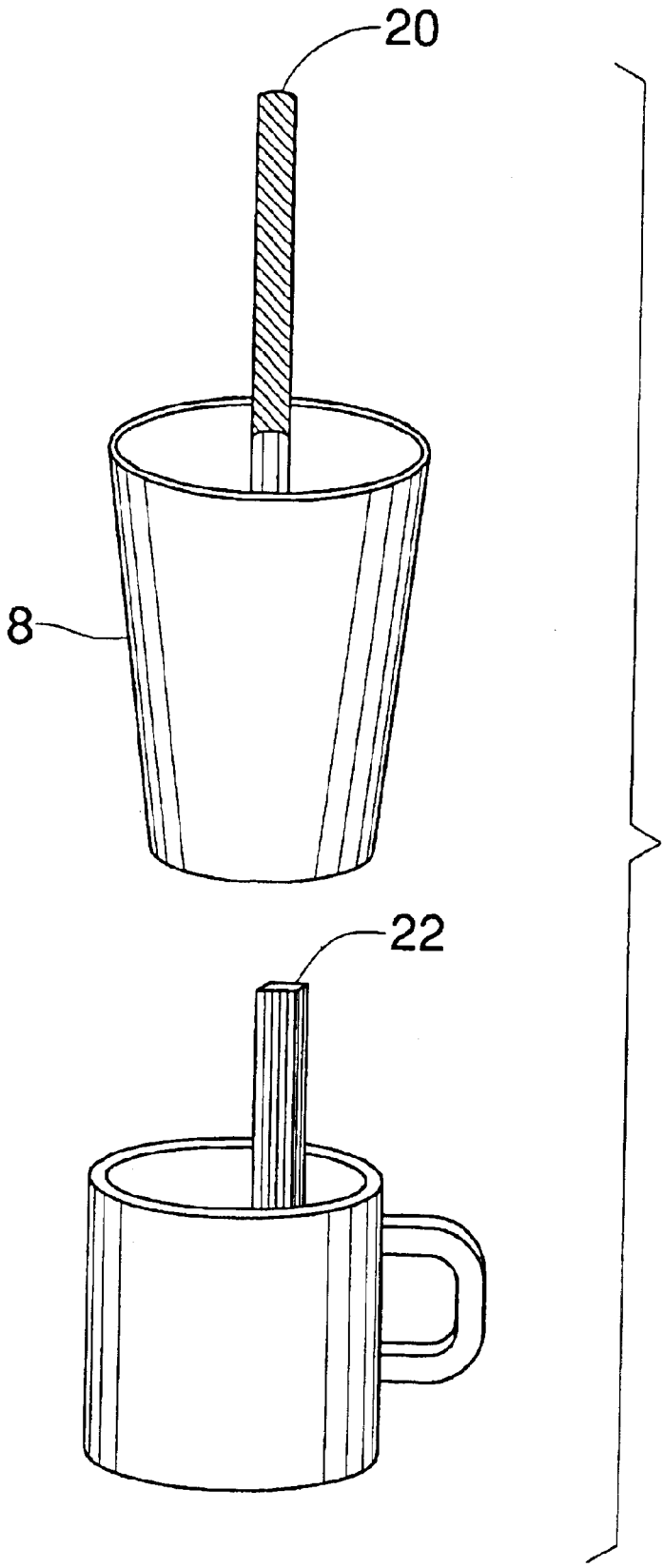
FIG. 2 is a schematic perspective front view of the present invention.
Figure 3:
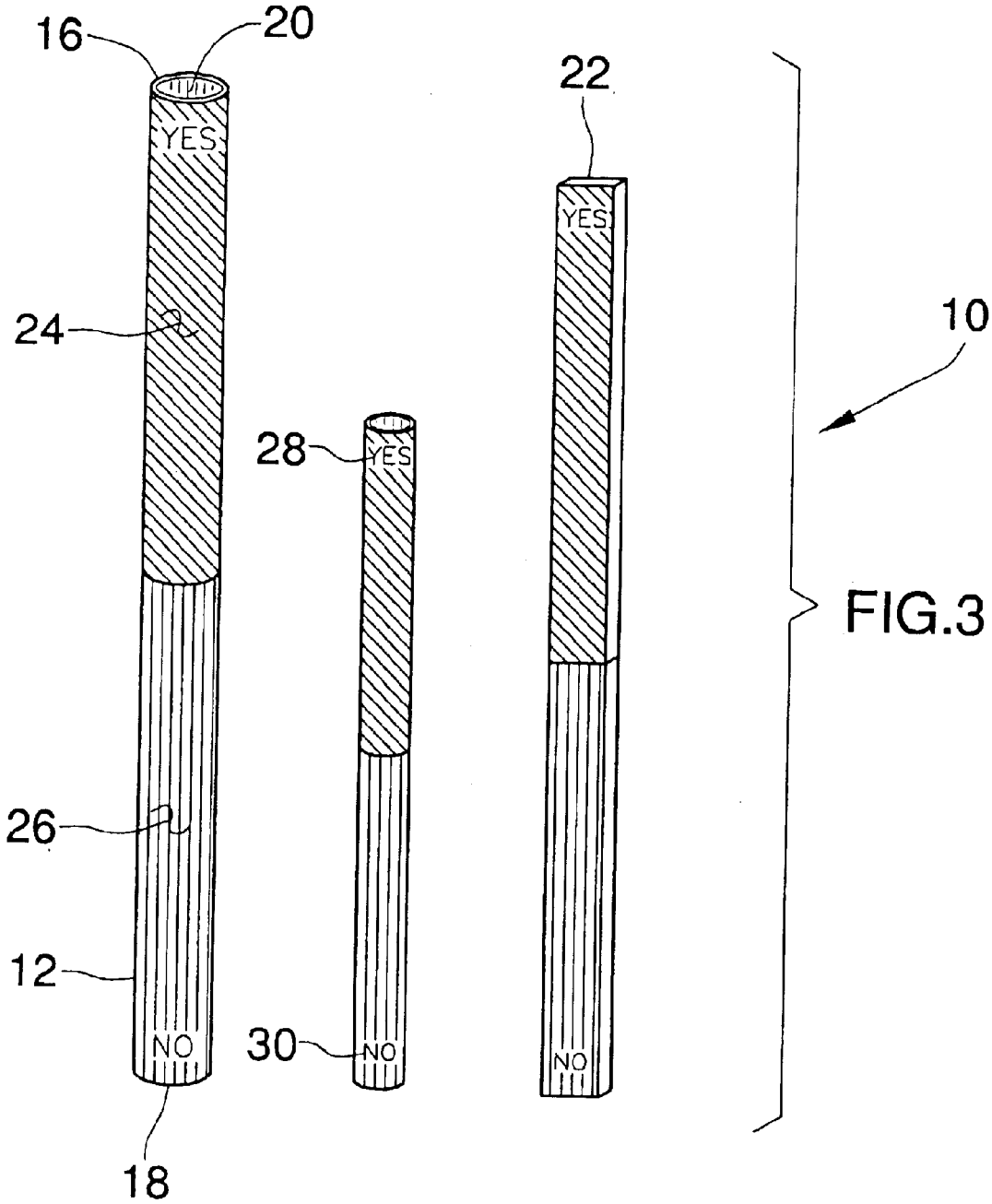
FIG. 3 is a schematic in-use view of the present invention.

With reference now to the drawings, and in particular to FIGS. 1 through 3 thereof, a new drink refill indicating device embodying the principles and concepts of the present invention and generally designated by the reference numeral 10 will be described.

As best illustrated in FIGS. 1 through 3, the refill indicator 10 generally comprises an elongated member 12 for removably positioning in a drink container 8. The elongated member 12 has a first end 16 and a second end 18 and preferably comprises a tubular member 20 though solid, drink stirring elongated members 22 are also contemplated. The elongated member 12, if also tubular, preferably has a substantially circular cross-section taken traverse to a longitudinal axis of the elongated member 12. FIG. 3 depicts various sizes and shapes of the device.

A first color indicia 24 is positioned on an outer surface of the elongated member 12 and generally extends from the first end 16 to a middle area of the elongated member 12. A second color indicia 26 is positioned on an outer surface of the elongated member and generally extends from the second end 18 to a middle area of the elongated member 12. Preferably, the first color indicia 24 comprises a green color and the second color indicia 26 comprises a red color though any color combination may be used.

Additionally, an affirmative refill word indicia 28 may be positioned on the elongated member 12 and positioned adjacent to the first end 16 and a negative refill word indicia 30 is positioned on the elongated member 12 and is positioned adjacent to the second end 18. The affirmative word indicia 28 preferably include the words "yes" or "refill," while the negative refill word indicia 30 preferably include "no" or "no refill."

In use, a patron, when desiring a refill or another beverage, places the second end 18 into the drink container 8 so that the first end 16 of the elongated member 12 is visible. The gives a visual indication to the wait staff that a refill is desired. If the patron does not desire a refill or another beverage, the first end 16 is retained in the drink container 8, where it was presumably positioned when served, so that the second end 18 is visible. The word indicia 28, 30 primarily serves the patron by indicating to the patron which end of the tubular member 12 should be positioned in the drink container 8. For tubular versions of the device, the device 10 is also used as a straw whereas solid versions are typically used as stirring devices.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A drink refill indicator comprising:

an elongated member for removably positioning in a drink container, said elongated member having a first end and a second end;

a first color indicia being positioned on an outer surface of said elongated member and generally extending from said first end to a middle of said elongated member;

a second color indicia being positioned on an outer surface of said elongated member and generally extending from said second end to a middle of said elongated member;

an affirmative refill word indicia being positioned on said elongated member and being positioned adjacent to said first end, a negative refill word indicia being positioned on said elongated member and being positioned adjacent to said second end; and wherein the first color indicia indicates that a refill is requested while the second color indicia indicates that a refill is not desired.

2. The drink refill indicator of claim 1, wherein said elongated member comprises a tubular member.

3. The drink refill indicator of claim 2, wherein said elongated member has a substantially circular cross-section taken traverse to a longitudinal axis of said elongated member.

4. The drink refill indicator of claim 1, wherein said elongated member has a substantially circular cross-section taken traverse to a longitudinal axis of said elongated member.

5. The drink refill indicator of claim 1, wherein said first color indicia comprises a green color and said second color indicia comprises a red color.

6. The drink refill indicator of claim 2, wherein said first color indicia comprises a green color and said second color indicia comprises a red color.

7. A drink refill indicator comprising:

an elongated member for removably positioning in a drink container, said elongated member having a first end and a second end, said elongated member comprising a tubular member, said elongated member having a substantially circular cross-section taken traverse to a longitudinal axis of said elongated member;

a first color indicia being positioned on an outer surface of said elongated member and generally extending from said first end to a middle of said elongated member, said first color indicia comprising a green color;

a second color indicia being positioned on an outer surface of said elongated member and generally extending from said second end to a middle of said elongated member, said second color indicia comprising a red color;

an affirmative refill word indicia being positioned on said elongated member and being positioned adjacent to said first end; and a negative refill word indicia being positioned on said elongated member and being positioned adjacent to said second end.

* * * * *